United States Patent [19]

Hopfensperger

[11] Patent Number: 4,705,453

[45] Date of Patent: Nov. 10, 1987

[54] TANGENTIAL BLOWER

[75] Inventor: Reinhold Hopfensperger, Dietelskirchen, Fed. Rep. of Germany

[73] Assignee: Alcatel N.V., Amsterdam, Netherlands

[21] Appl. No.: 901,987

[22] Filed: Sep. 2, 1986

Related U.S. Application Data

[63] Continuation of Ser. No. 823,966, Jan. 29, 1986, abandoned, which is a continuation of Ser. No. 631,133, Jul. 16, 1984, abandoned.

[30] Foreign Application Priority Data

Jul. 23, 1983 [DE] Fed. Rep. of Germany ..... 3326651

[51] Int. Cl.[4] ..... F04D 29/66

[52] U.S. Cl. ..... 415/119; 415/54

[58] Field of Search ..... 415/119, 54, 53 R, DIG. 1

[56] References Cited

U.S. PATENT DOCUMENTS

| | | | |
|---|---|---|---|
| 3,415,443 | 12/1968 | Glucksman | 415/54 |
| 3,522,994 | 8/1970 | Zenkner | 415/119 |
| 3,695,775 | 10/1972 | Zenkner | 415/54 |

FOREIGN PATENT DOCUMENTS

| | | | |
|---|---|---|---|
| 2747135 | 4/1978 | Fed. Rep. of Germany | 415/119 |
| 1250046 | 11/1960 | France | 415/54 |
| 6112 | 1/1977 | Japan | 415/119 |

*Primary Examiner*—Robert E. Garrett
*Assistant Examiner*—John Kwon
*Attorney, Agent, or Firm*—Spencer & Frank

[57] ABSTRACT

A tangential blower, especially one having small external dimensions, which is essentially improved in its noise behavior. The baffle plate of the blower has a particular curved or shell shaped construction, and the vortex former consists of three leg portions connected to one another.

1 Claim, 10 Drawing Figures

ΔPst
Pa
24
20
16
12
8
4
0
4
8
12
16
20
24
28
30
V̇
l/s
15
16

TANGENTIAL BLOWER

This is a continuation of application Ser. No. 823,966 filed Jan. 29, 1986, now abandoned, which is a continuation of application Ser. No. 631,133, filed 7-16-84, now abandoned.

BACKGROUND OF THE INVENTION

The present invention relates to a tangential blower of a small size, and more particularly to a rotor with blade edges extending parallel to the axis of rotation, a baffle plate partly enclosing the rotor, and housing side walls completely or partly enclosing the rotor ends.

PRIOR ART STATEMENT

The phrase "small size" refers to such types of tangential blowers which employ a rotor having a diameter of e.g. 40 mm.

Such tangential blowers are used in large numbers, e.g., in household appliances, fan heaters, air condition equipment, convectors, copying machines, projectors, plug in units for electrical and electronic equipment, and the like.

Certain flat airstream types of tangential blowers are constructed not to exceed certain external dimensions. Such tangential blowers have maximum external dimensions (overall height . overall depth) of about 60×60 mm. Tangential blowers of this type are required owing to the increasingly more compact construction of, e.g., copying machines.

The rotors of the small size tangential blowers of the prior art also have correspondingly small diameters. When such small rotors are used, it is difficult to achieve an air output which corresponds to the rotor diameter. Rotors having such a small diameter naturally operate at a low Reynolds numbers. This is indicative of a certain airflow condition.

The Reynolds number of a tangential blower can be raised by increasing the angular velocity with which it is driven. Such a measure, however, causes a considerable increase in the noise generated.

SUMMARY OF THE INVENTION

In accordance with the tangential blower of the present invention, there is provided a miniature blower which produces a flat airstream and, in the free air output operation or with a little throttling, which delivers a high volume airstream and, at the same time, develops very little noise.

According to the invention, a spiral baffle plate is provided by starting out from a point of the greatest proximity to a rotor, in a direction toward the inlet side as well as to the outlet side. The baffle plate thus continuously departs from the rotor and, on the inlet sided rim of the housing, ends up in a bent off end. Further, the vortex former comprises three legs which are disposed certain ways.

BRIEF DESCRIPTION OF THE DRAWINGS

In the accompanying drawings which illustrate exemplary embodiments of the present invention.

DESCRIPTION OF THE PREFERRED EMBODIMENTS

Figure 1:
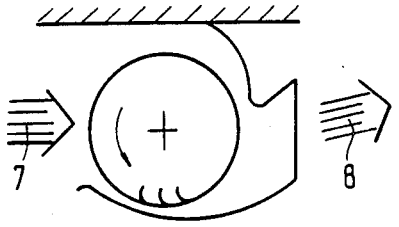
FIG. 1 is a diagrammatic view of a tangential blower for a flat (0°) airstream.
Figure 2:
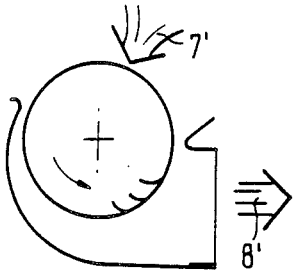
FIG. 2 is a diagrammatic view of a tangential blower for a rectangular (90° ) airstream.

FIGS. 1 and 2 show the difference between a tangential blower producing an essentially flat (0°) airstream (FIG. 1), and a tangential blower producing an essentially rectangular (90° ) airstream. With a flat-airstream type of tangential blower, both the intake direction 7 and the outlet direction 8 are close to or on one straight line. In distinction thereto, with a tangential blower producing a rectangular (90°) airstream, the intake direction 7' (FIG. 2) is almost at a right angle in relation to the outlet direction 8'. One might speak of a mixed airstream in cases where the intake and outlet directions are at an angle of about 45° in relation to one another.

When small external dimensions are employed and there is a small rotor diameter which causes a low Reynolds number to exist, it infrequently is possible to obtain an acceptable noise radiation. However, in the case of a flat airstream blower, it is difficult to produce a pressure maximum which is comparable to that of a blower producing a 90° airstream. The reason for this is that there is a very small high pressure chamber in which the kinetic energy of flow is converted to potential (pressure) energy.

Figure 3:
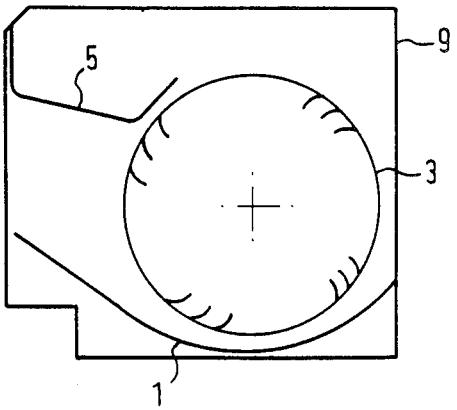
FIG. 3 is a diagrammatic view of a conventional type of tangential blower for a flat airstream.

FIG. 3 shows a configuration of a conventional blower which is sold by the firm Toshiba. This conventional type of tangential blower has external dimensions of about 60×65 mm, as can be recognized from a side wall 9. With this conventional type of tangential blower, a baffle plate 1 extends partly at a constant spacing around a rotor 3, while the pressure sided part of the baffle plate 1 ends up as a straight line. With this known type of tangential blower, the vortex former 5 is practically of a two part construction, of which one part is a straight line extending at an almost constant spacing from the rotor circumference, and of which the other part extends as a straight line in a direction towards the edge of a housing.

Figure 4:
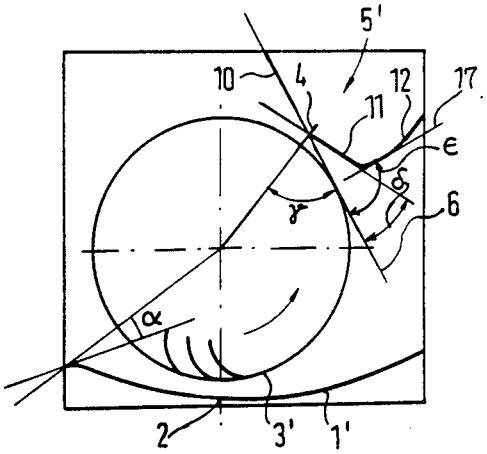
FIG. 4 is a diagrammatic view of a tangential blower constructed according to the present invention, for operation without recirculation.

Compared to this, FIG. 4 shows the configuration of a tangential blower according to the invention whose external dimensions are somewhat smaller than those of the conventional type of tangential blower, i.e. about 60×60 mm. A baffle plate 1' is of a slightly curved construction and has at 2 the point of its greatest proximity to a surface of a rotor 3'. The inlet or suction sided end of the baffle plate 1' is bent off in such a way that the baffle plate 1', per unit of length, departs more rapidly from the rotor surface than over its remaining length.

A vortex former 5′ consists of three legs. A leg 10 is shown in a straight line which, at a point 4 (the point of greatest proximity of the vortex former 5′ to the rotor surface 3′), changes over to a leg 11. An angle $\delta$ exists between a line through the center of the rotor 3′ and the point 4, and leg 11 a linear continuation (imaginary extension) 6 of the leg 10. The linear continuation 6 of the leg 10 constitutes a tangent to the rotor 3′. The leg 11 is likewise a straight line and has a length more than one-fourth the radius of the rotor. The leg together with the tangent 6 forms an angle $\gamma$. The angle $\delta$ is sufficiently small so that an imaginary rearward (upstream) continuation of the leg 11 does not intersect the rotor 3′, but is spaced therefrom. There is a transition between the leg 11 and a leg 12. The vortex former 5′ is, at this transition, bent upwardly and extends either in a curved or several times bent manner toward the pressure sided edge of the housing. A tangent line 17 to the leg 12 within the area of the transition from leg 11 to leg 12, together with the tangent line 6 extending through point 4, forms an angle $\epsilon$ which is several times greater than $\delta$. The given embodiment of the present invention may have the following dimensions: the leg 10 may have a length of about 0.35 $\times$ rotor diameter (d). The leg 11 may have a length of about $0.25 \times d$, and the leg 12 may have a length of about $0.3 \times d$. At point 4, the vortex former 5′ is spaced from the rotor 3′ by about 0.06 d.

Figure 5:
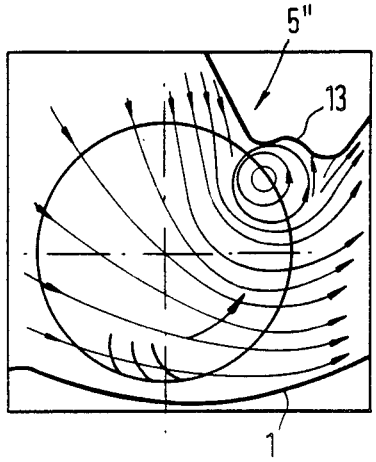
FIG. 5 is a diagrammatic view of one embodiment of a tangential blower according to the present invention, for the operation with a recirculation.

The embodiment as shown in FIG. 4 refers to a tangential blower operating without a recirculation. The novel tangential blower, however, may also be constructed in such a way as to permit operation with a recirculation. One such type of embodiment is shown in FIG. 5. The configuration of the tangential blower as shown in FIG. 5 differs from the one as shown in FIG. 4 in that a leg 13 no longer extends as a straight line, but has the shape of a bay or arching. In FIG. 5 the depth of the bay is about 20% of the width of the bay; a bay is herein defined as a concave surface whose depth is more than 10% of its width.

Figure 6:
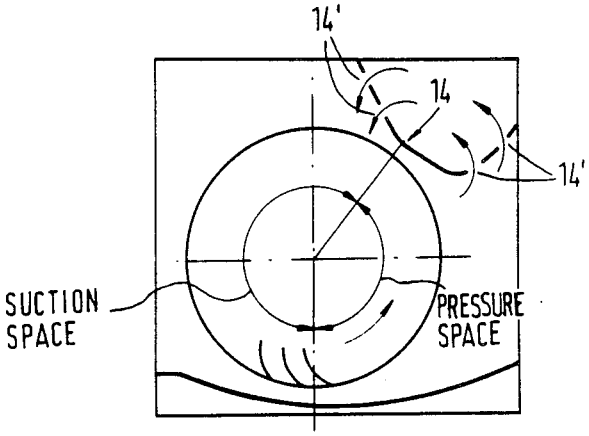
FIG. 6 is a diagrammatic view of another embodiment of the invention.

Another embodiment of the present invention relating to a tangential blower with recirculation is shown in FIG. 6. In this, the shape of a leg 14 may be almost or completely unchanged compared to that of the tangential blower shown in FIG. 4. The leg 14, however, is provided with openings 14′ which, as is indicated by arrows, permit a partial backstreaming from the pressure to the suction (inlet) side.

Figure 7:
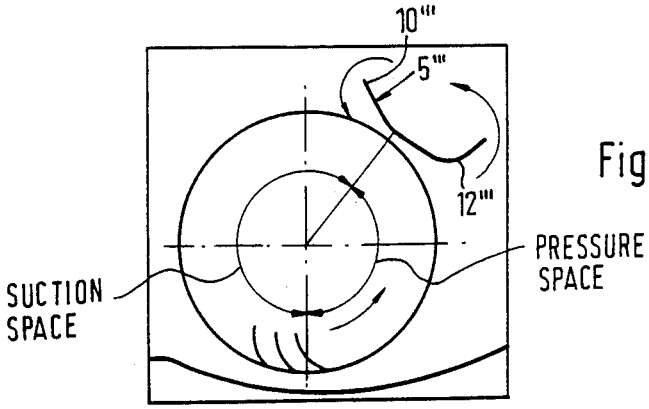
FIG. 7 is a diagrammatic view of still another embodiment of a tangential blower constructed according to the present invention, providing for a recirculation

A further embodiment relating to a recirculation type of tangential blower is shown in FIG. 7. This solution resides in the end sided reduction of a vortex former 5‴, that is, of the legs 10‴ and 12‴ thereof, so that also in this way there may be effected a partial backstreaming from the pressure to the suction (inlet) side (see the arrows). All of the measures explained in connection with FIGS. 5 to 7 are supposed to extend throughout the entire length of the vortex former 5‴.

Figure 8:
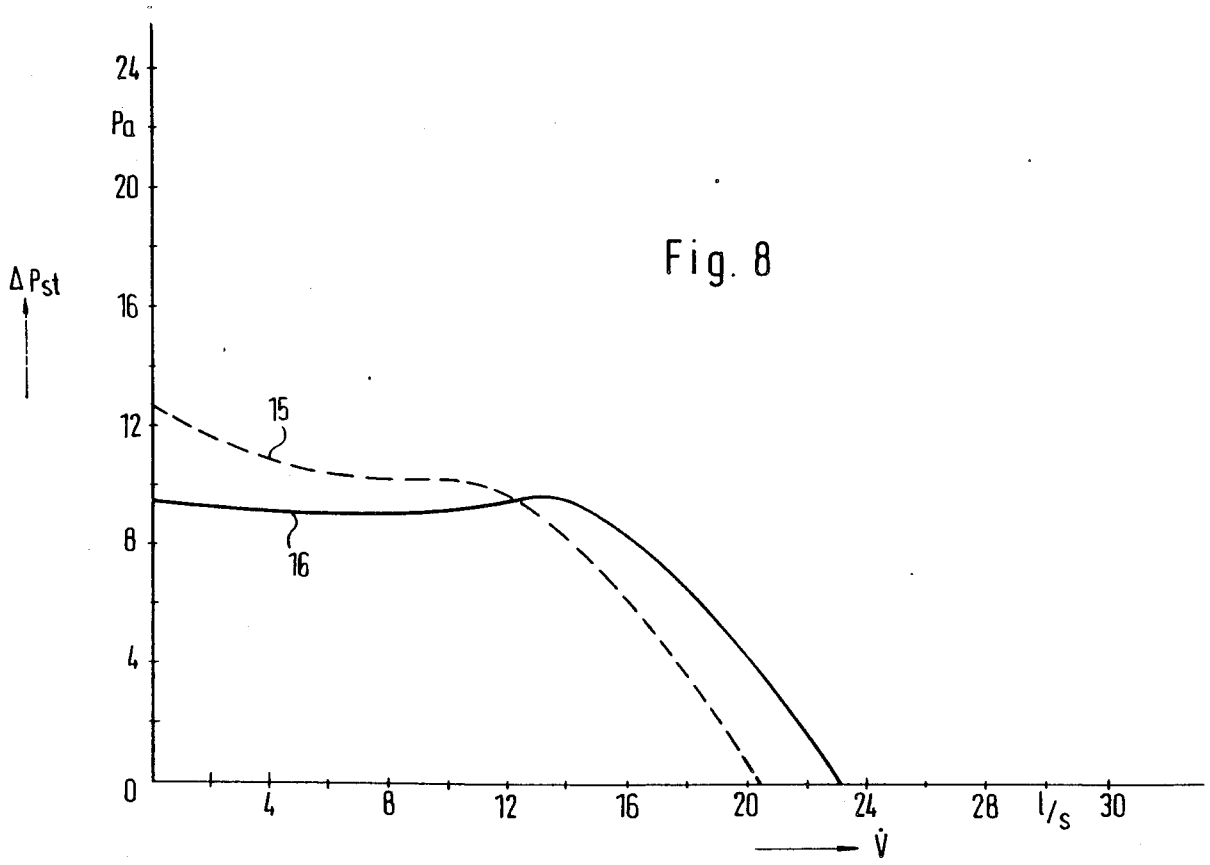
FIG. 8 is a graph of certain pressure volume current characteristics relating to tangential blowers of the type shown in FIGS. 3 and 4.

FIG. 8, with reference to the pressure volume current (rate-of-flow) characteristics, permits a comparison between the conventional type of tangential blower as shown in FIG. 3 (characteristic 15) and the novel type of tangential blower as shown in FIG. 4 (characteristic 16). It is evident from this comparison that the novel type of tangential blower—although having still smaller external dimensions than the conventional type of tangential blower—especially in free air output operation and with a little to medium throttling, shows to have a higher delivery efficiency.

Figure 10:
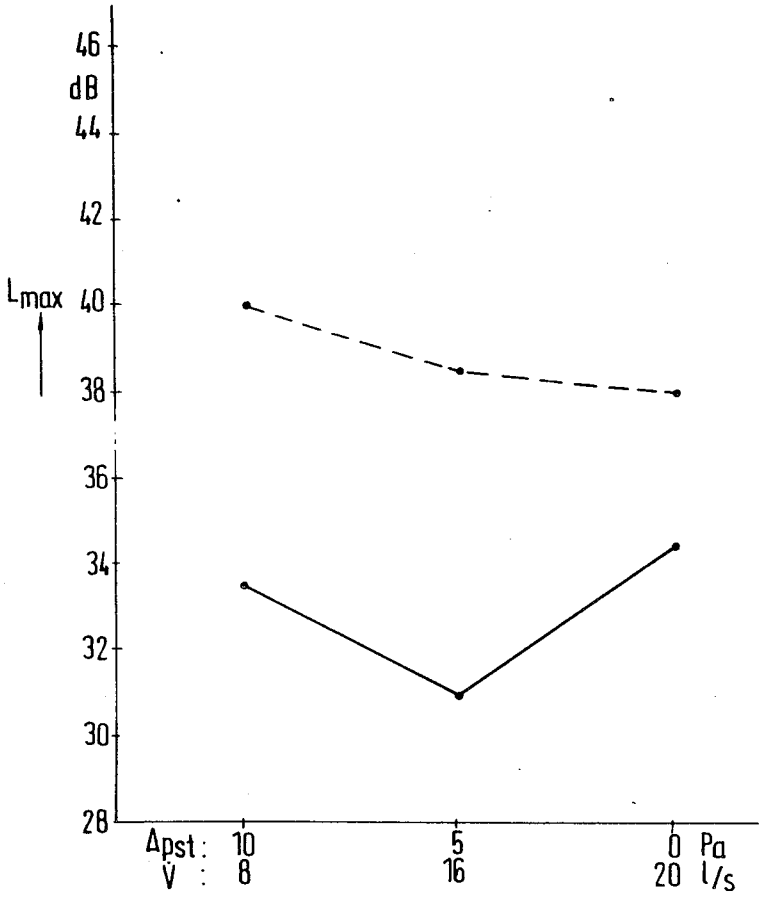
FIG. 10 is a graph of the maximum third level Lmax at different operating points relating to the tangential blowers shown in FIGS. 3 and 4.
Figure 9:
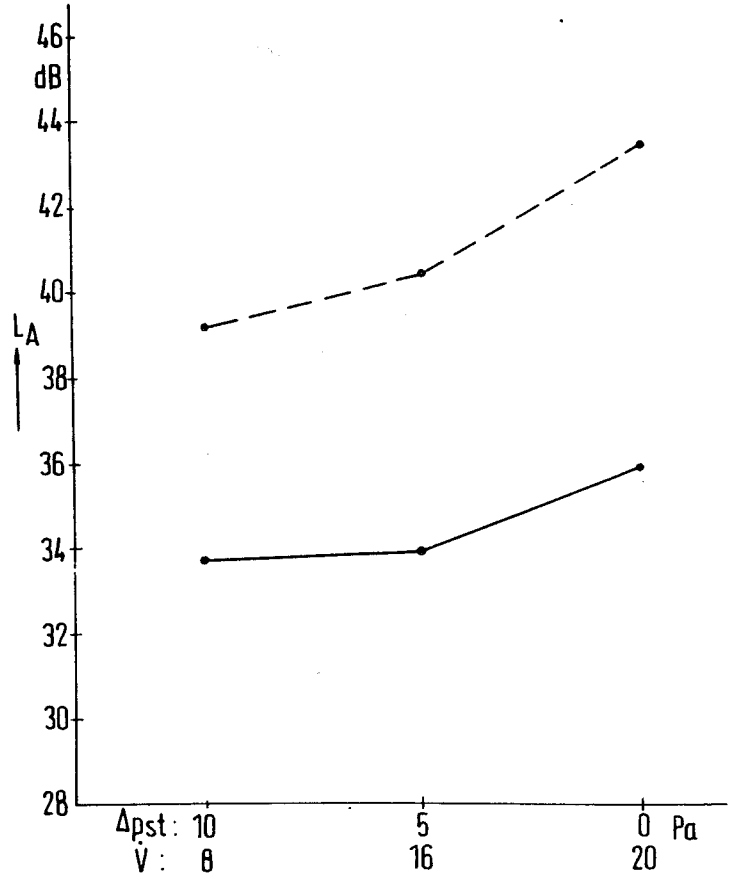
FIG. 9 is a graph showing the evaluated sound pressure level L (A) at different operating points relating to the tangential blowers shown in FIGS. 3 and 4.

The improvement in noise behavior is particularly evident from the comparison of the novel with the conventional type of tangential blower, as shown in FIGS. 9 and 10. In these figures, just like in FIG. 8, the sound pressure level values relating to the conventional type of tangential blower are shown in dashlines, and those relating to the tangential blower according to the invention are indicated by solid lines.

What is claimed is:

1. A miniature tangential air blower comprising: a housing; a rotor having a radius; said rotor being rotatably mounted in said housing about a predetermined axis, said rotor including blades having edges extending parallel to said axis; a baffle plate fixed in said housing and partly enclosing said rotor; and a vortex former fixed in said housing, said baffle plate and said vortex former defining an inlet at one side of said housing and defining an outlet at the opposite side of said housing; said baffle plate and said vortex former being positioned to direct air in largely the same direction at the inlet and outlet, said housing having side walls at least partly enclosing said rotor, said baffle plate being largely spiral in shape and continuously departing from said rotor from a first point of closest proximity to the rotor, said baffle plate having a bent end, said vortex former having an inlet or suction sided leg which, from a second point of its greatest proximity to said rotor, continuously departs therefrom in an upstream direction as viewed in a direction of air flow, said inlet leg being substantially straight and having an imaginary straight continuation constituting a tangent to the rotor, said vortex former having a substantially straight central leg that has a length greater than one-fourth the rotor radius and that departs continuously from said second point at an angle $\delta$ from said tangent; the angle $\delta$ being sufficiently small such that an imaginary upstream extension of said central leg is spaced from said rotor; said vortex former having a pressure sided leg extending at an angle $\epsilon$ from said tangent in a curved or several times bent off manner to an edge of said housing; wherein $\epsilon$ being a plurality of times greater than $\delta$.

* * * * *